US009850453B2

(12) United States Patent
Biel et al.

(10) Patent No.: US 9,850,453 B2
(45) **Date of Patent: *Dec. 26, 2017**

(54) AQUEOUS SOLUTIONS CONTAINING A COMPLEXING AGENT IN HIGH CONCENTRATION

(71) Applicant: BASF SE, Ludwigshafen (DE)

(72) Inventors: Markus Christian Biel, Mannheim (DE); Thomas Greindl, Maxdorf (DE); Markus Hartmann, Neustadt (DE); Wolfgang Staffel, Otterstadt (DE); Marta Reinoso Garcia, Dossenheim (DE)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/893,859

(22) PCT Filed: May 13, 2014

(86) PCT No.: PCT/EP2014/059727

§ 371 (c)(1),
(2) Date: Nov. 24, 2015

(87) PCT Pub. No.: WO2014/191199

PCT Pub. Date: Dec. 4, 2014

(65) Prior Publication Data

US 2016/0130531 A1 May 12, 2016

(30) Foreign Application Priority Data

May 27, 2013 (EP) ..... 13169341

(51) Int. Cl.

| | |
|---|---|
| ***C11D 3/20*** | (2006.01) |
| ***C11D 3/33*** | (2006.01) |
| ***C11D 3/34*** | (2006.01) |
| ***C11D 7/32*** | (2006.01) |
| ***C11D 7/26*** | (2006.01) |
| ***C11D 7/34*** | (2006.01) |

(52) U.S. Cl.

CPC ..... *C11D 3/33* (2013.01); *C11D 3/2079* (2013.01); *C11D 3/3409* (2013.01); *C11D 7/264* (2013.01); *C11D 7/3245* (2013.01); *C11D 7/34* (2013.01)

(58) Field of Classification Search

CPC .... C11D 3/20; C11D 3/33; C11D 3/34; C11D 7/32

See application file for complete search history.

(56) References Cited

U.S. PATENT DOCUMENTS

| | | | | |
|---|---|---|---|---|
| 8,535,450 | B2 | 9/2013 | Hueffer et al. | |
| 8,574,374 | B2 | 11/2013 | Hueffer et al. | |
| 8,709,990 | B2 | 4/2014 | Hueffer et al. | |
| 2009/0075855 | A1* | 3/2009 | Gibis | C11D 3/33 510/224 |
| 2010/0276152 | A1* | 11/2010 | De Wolf | C09K 8/74 166/308.2 |
| 2012/0260938 | A1 | 10/2012 | Zack et al. | |

FOREIGN PATENT DOCUMENTS

| | | | |
|---|---|---|---|
| WO | 2012/025160 | A1 | 3/2012 |
| WO | 2012/028203 | A1 | 3/2012 |
| WO | 2012/142396 | A1 | 10/2012 |
| WO | 2014/191198 | A1 | 12/2014 |

OTHER PUBLICATIONS

U.S. Appl. No. 14/892,820, filed Nov. 20, 2015, Markus Christian Biel, et al.

International Search Report and Written Opinion of the International Searching Authority dated Jun. 26, 2014 in PCT/EP14/59727 Filed May 13, 2014.

European Search Report dated Sep. 18, 2013 in EP 13169341.8 Filed May 27, 2013.

* cited by examiner

*Primary Examiner* — Brian P Mruk

(74) *Attorney, Agent, or Firm* — Oblon, McClelland, Maier & Neustadt, L.L.P.

(57) ABSTRACT

Aqueous solution comprising (A) in the range of from 30 to 60% by weight of a complexing agent, selected from the alkali metal salts of methylglycine diacetic acid and the alkali metal salts of glutamic acid diacetic acid, (B) in the range of from 1 to 25% by weight of at least one salt of a sulfonic acid or of an organic acid, percentages referring to the total respective aqueous solution.

20 Claims, No Drawings

AQUEOUS SOLUTIONS CONTAINING A COMPLEXING AGENT IN HIGH CONCENTRATION

The present invention is directed towards an aqueous solution comprising (A) in the range of from 30 to 60% by weight of a complexing agent, selected from the alkali metal salts of methylglycine diacetic acid and the alkali metal salts of glutamic acid diacetic acid, (B) in the range of from 1 to 25% by weight of at least one salt of a sulfonic acid or of an organic acid, percentages referring to the total respective aqueous solution, said aqueous solution being free from surfactants.

Complexing agents such as methyl glycine diacetic acid (MGDA) and glutamic acid diacetic acid (GLDA) and their respective alkali metal salts are useful sequestrants for alkaline earth metal ions such as $Ca^{2+}$ and $Mg^{2+}$. For that reason, they are recommended and used for various purposes such as laundry detergents and for automatic dishwashing (ADW) formulations, in particular for so-called phosphate-free laundry detergents and phosphate-free ADW formulations. For shipping such complexing agents, in most cases either solids such as granules are being applied or aqueous solutions.

Granules and powders are useful because the amount of water shipped can be neglected but for most mixing and formulation processes an extra dissolution step is required.

Many industrial users wish to obtain complexing agents in aqueous solutions that are as highly concentrated as possible. The lower the concentration of the requested complexing agent the more water is being shipped. Said water adds to the costs of transportation, and it has to be removed later. Although about 40% by weight solutions of MGDA and even 45% by weight solutions of GLDA can be made and stored at room temperature, local or temporarily colder solutions may lead to precipitation of the respective complexing agent, as well as nucleating by impurities. Said precipitations may lead to incrustations in pipes and containers, and/or to impurities or inhomogeneity during formulation.

It can be tried to increase the solubility of complexing agents by adding a solubilizing agent, for example a solubility enhancing polymer or a surfactant. However, many users wish to be flexible with their own detergent formulation, and they wish to avoid polymeric or surface-active additives in the complexing agent.

Additives that may enhance the solubility of the respective complexing agents may be considered but such additives should not negatively affect the properties of the respective complexing agent.

It was therefore the objective of the present invention to provide highly concentrated aqueous solutions of complexing agents such as MGDA or GLDA that are stable at temperatures in the range from zero to 50° C., without the addition of surfactants or polymers. It was further an objective of the present invention to provide a method for manufacture of highly concentrated aqueous solutions of complexing agents such as MGDA or GLDA that are stable at temperatures in the range from zero to 50° C. Neither such method nor such aqueous solution should require the use of additives that negatively affect the properties of the respective complexing agent.

Accordingly, the aqueous solutions defined at the outset have been found, hereinafter also being referred to as aqueous solutions according to the invention.

Aqueous solutions according to the invention contain (A) in the range of from 30 to 60% by weight of a complexing agent, hereinafter also being referred as "complexing agent (A)", selected from the alkali metal salts of methylglycine diacetic acid and the alkali metal salts of glutamic acid diacetic acid, (B) in the range of from 1 to 25% by weight of least one salt of a sulfonic acid or of an organic acid, said salt hereinafter also being referred to as "salt (B)", said aqueous solution being free from surfactants, percentages referring to the total respective aqueous solution according to the invention.

Complexing agent (A) is selected from alkali metal salts of methylglycine diacetic acid and the alkali metal salts of glutamic acid diacetic acid.

In the context of the present invention, alkali metal salts of methylglycine diacetic acid are selected from lithium salts, potassium salts and preferably sodium salts of methylglycine diacetic acid. Methylglycine diacetic acid can be partially or preferably fully neutralized with the respective alkali. In a preferred embodiment, an average of from 2.7 to 3 COOH groups of MGDA is neutralized with alkali metal, preferably with sodium. In a particularly preferred embodiment, complexing agent (A) is the trisodium salt of MGDA.

Likewise, alkali metal salts of glutamic acid diacetic acid are selected from lithium salts, potassium salts and preferably sodium salts of glutamic acid diacetic acid. Glutamic acid diacetic acid can be partially or preferably fully neutralized with the respective alkali. In a preferred embodiment, an average of from 3.5 to 4 COOH groups of GLDA is neutralized with alkali metal, preferably with sodium. In a particularly preferred embodiment, complexing agent (A) is the tetrasodium salt of GLDA.

In one embodiment of the present invention, aqueous solutions according to the invention contain in the range of from 30 to 60% by weight alkali metal salt of MGDA as complexing agent (A), preferably 35 to 50% by weight and even more preferably 37 to 45% by weight.

In one embodiment of the present invention, aqueous solutions according to the invention contain in the range of from 30 to 60% by weight alkali metal salt of GDA as complexing agent (A), preferably 45 to 58% by weight and even more preferably 46 to 53% by weight.

Complexing agent (A) can be selected from racemic mixtures of alkali metal salts of MGDA or GLDA, and of the pure enantiomers such as alkali metal salts of L-MGDA, alkali metal salts of L-GLDA, alkali metal salts of D-MGDA and alkali metal salts of D-GLDA, and of mixtures of enantiomerically enriched isomers.

In any way, minor amounts of complexing agent (A) may bear a cation other than alkali metal. It is thus possible that minor amounts, such as 0.01 to 5 mol- % of total complexing agent (A) bear alkali earth metal cations such as $Mg^{2+}$ or $Ca^{2+}$, or $Fe^{+2}$ or $Fe^{3+}$ cations.

Aqueous solutions according to the invention further comprise (B) in the range of from 1 to 25% by weight, preferably 3 to 15% by weight of salt (B).

In the context of the present invention, salt (B) is selected from the salts of mono- and dicarboxylic acids. Furthermore, salt (B) is thus different from complexing agent (A).

In a preferred embodiment of the present invention, salt (B) is selected from alkali metal salts of acetic acid, tartaric acid, lactic acid, maleic acid, fumaric acid, and malic acid.

Preferred examples of salt (B) are potassium acetate and sodium acetate.

In one embodiment of the present invention, salt (B) is the potassium salt of methyl sulfonic acid and preferably the sodium salt of methyl sulfonic acid.

Aqueous solutions according the invention furthermore contain water. In one embodiment of the present invention, in aqueous solutions according to the invention, the balance of complexing agent (A) and salt (B), and, optionally, inorganic base, is water. In other embodiments, aqueous solutions according to the invention may contain one or more liquids or solids other than complexing agent (A) and salt (B) and water.

The aqueous according to the present invention is free from surfactants. Free from surfactants shall mean, in the context of the present invention, that the total contents of surfactants is 0.1% by weight or less, referring to the amount of complexing agent (A). In a preferred embodiment, the term "free from surfactants" shall encompass a concentration in the range of from 50 ppm to 0.05%, both ppm and % referring to ppm by weight or % by weight, respectively, and referring to the total respective aqueous solution.

In one embodiment of the present invention, aqueous solutions according the invention have a pH value in the range of from 9 to 14, preferably from 10.5 to 13. The pH value is determined at ambient temperature.

The aqueous according to the present invention is preferably free from polymers. Free from polymers shall mean, in the context of the present invention, that the total contents of surfactants is 0.1% by weight or less, referring to the amount of complexing agent (A). However, polyethylene glycol (C) is not being considered a polymer in the context of the present invention.

In one embodiment of the present invention, aqueous solutions according to the present invention may contain at least one inorganic base, for example potassium hydroxide or preferably sodium hydroxide. Preferred is an amount of 0.1 to 20 mol- % of inorganic base, referring to the total of COOH groups in complexing agent.

In one embodiment of the present invention, aqueous solutions according to the invention further comprise (C) at least one polyethylene glycol with an average molecular weight $M_n$ in the range of from 400 to 10,000 g/mol, hereinafter also being referred to as "polyethylene glycol (C)", preferably 600 to 6,000 g/mol.

In one embodiment of the present invention, polyethylene glycol (C) may be capped, that is converted to a polyether, for example with one methyl group per molecule. In another embodiment, polyethylene glycol (C) bears two hydroxyl groups per molecule.

In one embodiment of the present invention, aqueous solutions according to the invention may contain in the range of from 1 to 20% by weight, preferably 5 to 15% by weight of polyethylene glycol (C).

The average molecular weight $M_n$ of polyethylene glycol (C) can be determined, for example, by determining the hydroxyl number, preferably according to DIN 53240-1: 2012-07.

In other embodiments of the present invention, aqueous solutions according to the invention do not contain any polyethylene glycol (C).

In one embodiment of the present invention, complexing agent (A) may contain minor amounts of impurities stemming from its synthesis, such as lactic acid, alanine, propionic acid or the like. "Minor amounts" in this context refers to a total of 0.1 to 1% by weight, referring to complexing agent (A).

In one embodiment of the present invention, aqueous solutions according to the invention may have a dynamic viscosity in the range of from 80 to 500 mPa·s, preferably up to 100 mPa·s, determined according to DIN 53018-1:2008-09 at 25° C.

In one embodiment of the present invention, aqueous solutions according to the invention may have a color number according to Hazen in the range of from 15 to 400, preferably to 360, determined according to DIN EN 1557: 1997-03 at 25° C.

In one embodiment of the present invention, aqueous solutions according to the present invention have a total solids content in the range of from 31 to 65% by weight, preferably at least 38% by weight.

Aqueous solutions according to the invention exhibit extremely low a tendency of having solid precipitates of complexing agent (A) or other solids. Therefore, they can be stored and transported in pipes and/or containers without any residue, even at temperatures close to the freezing point of the respective aqueous solution according to the invention.

Another aspect of the present invention is thus the use of of aqueous solutions according to the invention for transportation in a pipe or a container. Transportation in a pipe or a container in the context of the present invention preferably does not refer to parts of the plant in which complexing agent (A) is being manufactured, nor does it refer to storage buildings that form part of the respective production plant in which complexing agent (A) has being manufactured. Containers can, for example, be selected from tanks, bottles, carts, road container, and tank wagons. Pipes can have any diameter, for example in the range of from 5 cm to 1 m, and they can be made of any material which is stable to the alkaline solution of complexing agent (A). Transportation in pipes can also include pumps that form part of the overall transportation system.

Another aspect of the present invention is a process for making aqueous solutions according to the invention, said process also being referred to as inventive process. The inventive process comprises the step of combining an aqueous solution of complexing agent (A) with salt (B), said salt (B) being applied as solid or in aqueous solution.

In one embodiment, said combination step may be followed by removal of excess water. Water will be removed as measure in the inventive process in particular in such embodiments when aqueous solution of complexing agent (A) has a concentration of less than 40% by weight, in particular less than 35% by weight.

In one embodiment of the present invention, the combination of aqueous solution of complexing agent (A) with salt (B) may be performed at a temperature in the range of from 30 to 75° C., preferably 25 to 50° C. In another embodiment of the present invention, aqueous solution of complexing agent (A) can be combined with salt (B) at ambient temperature or slightly elevated temperature, for example in the range of from 21 to 29° C.

The inventive process can be performed at any pressure, for example at a pressure in the range of from 500 mbar to 25 bar. Normal pressure is preferred.

The inventive process can be performed in any type of vessel, for example in a stirred tank reactor or in a pipe with means for dosage of salt (B) or in a beaker, flask or bottle.

Removal of water can be achieved, for example, with the help of membranes or by evaporation. Evaporation of water can be performed by distilling off water, with or without stirring, at temperature in the range of from 20 to 65° C.

Another aspect of the present invention is the use of aqueous solutions according to the invention for the manufacture of a laundry care or dish wash formulation, said aspect also being referred to as inventive use or inventive application. Another aspect of the present invention is a process for making a laundry care or dish wash formulation by using at least one aqueous solution according to the invention. The inventive use and the respective process comprise the step of mixing at least one aqueous solution according to the invention with at least one ingredient for a laundry care or dish wash formulation, for example at least one surfactant, optionally followed by at least partially removing the water.

The invention is further illustrated by the following working examples.

WORKING EXAMPLES

Percentages refer to % by weight unless expressly noted otherwise.

The following substances were used:

Complexing agent (A.1): trisodium salt of MGDA, provided as 40% by weight aqueous solution, pH value: 13

Salt (B.1): sodium acetate, solid

Salt (B.2): potassium acetate, solid

I. Manufacture of concentrated aqueous solutions according to the invention

I.1 Manufacture of Aqueous Solutions containing (A.1) and (B.1)

A 25 ml glass bottle with plastic stopper was charged with 22.5 g of the above 40% by weight aqueous solution of (A.1). It was warmed to 75° C. To said solution, 2.5 g of (B.1) were added under repeated shaking. The resulting aqueous solution had a total solids content of 46% by weight. It was a clear solution and did not show any sign of crystallization or precipitation of MGDA even after 30 days at 23° C.

I.2 Manufacture of Aqueous Solutions Containing (A.1) and (B.1)

A 25 ml glass bottle with plastic stopper was charged with 20 g of the above 40% by weight aqueous solution of (A.1). It was warmed to 75° C. To said solution, 5 g of (B.1) were added under repeated shaking. The resulting aqueous solution had a total solids content of 52% by weight. It was a clear solution and did not show any sign of crystallization or precipitation of MGDA even after 30 days at 23° C.

I.3 Manufacture of Aqueous Solutions Containing (A.1) and (B.2)

A 25 ml glass bottle with plastic stopper was charged with 22.5 g of the above 40% by weight aqueous solution of (A.1). It was warmed to 75° C. To said solution, 2.5 g of (B.2) were added under repeated shaking. The resulting aqueous solution had a total solids content of 46% by weight. It was a clear solution and did not show any sign of crystallization or precipitation of MGDA even after 30 days at 23° C.

I.4 Manufacture of Aqueous Solutions Containing (A.1) and (B.2)

A 25 ml glass bottle with plastic stopper was charged with 20 g of the above 40% by weight aqueous solution of (A.1). It was warmed to 75° C. To said solution, 5 g of (B.2) were added under repeated shaking. The resulting aqueous solution had a total solids content of 52% by weight. It was a clear solution and did not show any sign of crystallization or precipitation of MGDA even after 30 days at 23° C.

The invention claimed is:

1. An aqueous solution, comprising:

(A) from 30 to 60% by weight of a complexing agent, which is selected from the group consisting of an alkali metal salt of methylglycine diacetic acid and an alkali metal salt of glutamic acid diacetic acid, and (B) from 1 to 25% by weight of at least one salt of a sulfonic acid or of an organic acid, based on a total weight of the aqueous solution, wherein the aqueous solution is free from surfactants, wherein the aqueous solution has a total solids content from 31 to 65% by weight, and wherein a pH of the aqueous solution is from 9 to 14.

2. The aqueous solution according to claim 1 having the pH value of from 9 to 13.

3. The aqueous solution according to claim 1, wherein (B) is at least one alkali metal salt of acetic acid, tartaric acid, lactic acid, maleic acid, fumaric acid, or of malic acid.

4. The aqueous solution according to claim 1, wherein (B) is at least one alkali metal salt of methyl sulfonic acid.

5. The aqueous solution according to claim 1, further comprising:

(C) a polyethylene glycol having an average molecular weight $M_n$ of from 400 to 10,000 g/mol.

6. A process for making the aqueous solution according to claim 1, the process comprising combining the complexing agent (A) with the salt (B), thereby forming the aqueous solution.

7. A process for manufacturing a laundry care or dish wash formulation, the process comprising:

employing the aqueous solutions according to claim 1 in the process.

8. A process comprising transporting the aqueous solution according to claim 1 in a pipe or a container.

9. The aqueous solution according to claim 1, wherein the alkali metal salt of methylglycine diacetic acid is a lithium salt, potassium salt, sodium salt, or a combination thereof.

10. The aqueous solution according to claim 1, wherein the methylglycine diacetic acid is partially or fully neutralized with a respective alkali.

11. The aqueous solution according to claim 1, wherein an average of from 2.7 to 3 COOH groups of the methylglycine diacetic acid is neutralized with an alkali metal.

12. The aqueous solution according to claim 1, wherein the complexing agent (A) is a trisodium salt of the methylglycine diacetic acid.

13. The aqueous solution according to claim 1, comprising from 35 to 50% by weight of the alkali metal salt of methylglycine diacetic acid as the complexing agent (A).

14. The aqueous solution according to claim 1, comprising from 37 to 45% by weight of the alkali metal salt of methylglycine diacetic acid as the complexing agent (A).

15. The aqueous solution according to claim 1, comprising from 45 to 58% by weight of the alkali metal salt of glutamic acid diacetic acid as the complexing agent (A).

16. The aqueous solution according to claim 1, comprising from 46 to 53% by weight of the alkali metal salt of glutamic acid diacetic acid as the complexing agent (A).

17. The aqueous solution according to claim 5, wherein the polyethylene glycol has an average molecular weight $M_n$ of from 600 to 6,000 g/mol.

18. The aqueous solution according to claim 5, comprising from 1 to 20% by weight of the polyethylene glycol (C).

19. The aqueous solution according to claim 1 having a dynamic viscosity of from 80 to 500 mPa·s determined according to DIN 53018-1.2008-09 at 25° C.

20. The aqueous solution according to claim 1 having a Hazen color number of from 15 to 400 determined according to DIN EN 1557:1997-03 at 25° C.

* * * * *